United States Patent [19]

Kataoka

[11] Patent Number: 4,628,883

[45] Date of Patent: Dec. 16, 1986

[54] AIR-FUEL RATIO CONTROL SYSTEM

[75] Inventor: Ryuji Kataoka, Mitaka, Japan

[73] Assignee: Fuji Jukogyo Kabushiki Kaisha, Tokyo, Japan

[21] Appl. No.: 722,901

[22] Filed: Apr. 12, 1985

[30] Foreign Application Priority Data

Apr. 16, 1984 [JP] Japan ..... 59-76823

[51] Int. Cl.[4] ..... F02M 51/00; F02D 41/04; F02D 41/14

[52] U.S. Cl. ..... 123/489; 123/491; 123/492; 123/493

[58] Field of Search ..... 123/440, 489, 491, 492, 123/493

[56] References Cited

U.S. PATENT DOCUMENTS 4,365,603 12/1982 Shikata et al. ..... 123/489 X
4,388,905 6/1983 Kurihara ..... 123/440
4,408,588 10/1983 Mausner ..... 123/489
4,469,074 9/1984 Takao et al. ..... 123/492
4,488,529 12/1984 Nishida et al. ..... 123/489 X
4,492,204 1/1985 Bertsch et al. ..... 123/489

FOREIGN PATENT DOCUMENTS 53-13021 2/1978 Japan .
54-117828 9/1979 Japan .
56-162250 12/1981 Japan .

*Primary Examiner*—Willis R. Wolfe, Jr.
*Attorney, Agent, or Firm*—Martin A. Farber

[57] ABSTRACT

A feedback air-fuel ratio control system for an internal combustion engine has an $O_2$-sensor for detecting the concentration of oxygen in exhaust gases of the engine, a coolant temperature sensor, and a circuit for disabling the feedback control operation at a low coolant temperature during warming-up of the engine. The feedback control system is also disabled when the engine is rapidly accelerated or decelerated, even if the engine is warming-up at coolant temperatures greater than the low coolant temperature state.

9 Claims, 4 Drawing Figures

AIR-FUEL RATIO CONTROL SYSTEM

BACKGROUND OF THE INVENTION

The present invention relates to an air-fuel ratio control system for an internal combustion engine for a motor vehicle provided with a three-way catalytic converter in an exhaust system, and with an $O_2$-sensor for detecting the oxygen concentration of exhaust gases, and more particularly to a feedback control system for controlling air-fuel ratio during rapid acceleration and deceleration of the motor vehicle.

The air-fuel ratio control system responds to the feedback signal from the $O_2$-sensor to control the air-fuel ratio of the air-fuel mixture to a stoichiometric air-fuel ratio at which ratio the three-way converter is most effective. Such a feedback control operates under conditions of a coolant temperature higher than a predetermined value and when the activated $O_2$-sensor has a higher body temperature of the sensor than a predetermined value. When either the coolant temperature or $O_2$-sensor temperature is lower than the predetermined values, the feedback control system is disabled and the air-fuel ratio control signal is fixed to a constant value to hold the air-fuel ratio at a fixed value.

On the other hand, even if the feedback control operates under the normal conditions, when an accelerator pedal of the motor vehicle is fully depressed, the air-fuel ratio is fixed to enrich the mixture so as to meet the acceleration of the vehicle. Japanese Patent Laid Open No. 53-13021 discloses an example of such an enrichment system.

In order to increase the emission control range in engine operation, it is preferable to set the predetermined temperature, at which the feedback control system is enabled, to a lower value. On the contrary, in order to insure driveability during warming-up of the engine, it is preferable to set the temperature, at which the air-fuel ratio is fixed to enrich the mixture, to a higher value. To meet both requirements, usually the coolant temperature as the condition for enabling the feedback control system is set to a value between 20° and 50° C.

However, intake air is not sufficiently pre-heated in the intake manifold of the engine at a coolant temperature below 80° C., so that unvaporized fuel sticks to the inner wall of the intake manifold. The sticking of fuel to the wall causes the response of the feedback control operation to be delayed, increasing the amplitude of the oscillation of the system which increases deviation of the air-fuel ratio from the stoichiometric air-fuel ratio. Such a large deviation of the air-fuel ratio is further increased during rapid acceleration and rapid deceleration, causing an excessively rich or lean air-fuel mixture which causes the emission control effect to deteriorate. Japanese Patent Laid Open No. 56-162250 discloses an air-fuel ratio control system which operates to enrich the air-fuel mixture to a maximum rich value at a cold engine when rapidly accelerated. However, it is not always desirable to provide the maximum rich mixture.

SUMMARY OF THE INVENTION

An object of the present invention is to provide an air-fuel ratio control system which may properly control the air-fuel ratio at rapid acceleration and deceleration during cold engine operation to improve the emission control and the driveability of the vehicle.

It is a further object of the present invention to provide a system comprising an $O_2$-sensor for detecting the concentration of oxygen in exhaust gases, an electronic feedback control circuit comprising a comparator for comparing an output signal of the $O_2$-sensor, control means responsive to an output of the comparator to produce a control signal, and a driving circuit responsive to the control signal for driving a fuel supply means and for controlling the air-fuel ratio to a value approximately equal to the stoichiometric air-fuel ratio. The system further comprises a coolant temperature sensor for producing a temperature signal dependent on the temperature of the coolant of the engine, first detecting means for detecting rapid acceleration and deceleration of the engine for producing an engine operation signal, and means operatively responsive to the temperature signal of the coolant temperature sensor, feedback control interrupting signal for the feedback control circuit when the coolant temperature is lower than a predetermined lower temperature or when the coolant temperature is lower than a predetermined higher temperature and the engine operative signal occurs.

In an aspect of the present invention, the first detecting means is a throttle sensor for detecting the angular velocity of a throttle valve of the engine, and a second detecting means detects activation of the $O_2$-sensor and comprises a deciding circuit for comparing the output voltage of the $O_2$-sensor with a reference voltage which is an $O_2$-sensor activated voltage. When the reference voltage is not reached the feedback control interrupting signal is also produced.

The other objects and features of this invention will be apparently understood from the following description with reference to the accompanying drawings.

BRIEF DESCRIPTION OF DRAWINGS

FIGS. *2a, 2b* show a block diagram of an air-fuel control circuit in accordance with the present invention.

DETAILED DESCRIPTION OF THE PREFERRED EMBODIMENTS

Figure 1:
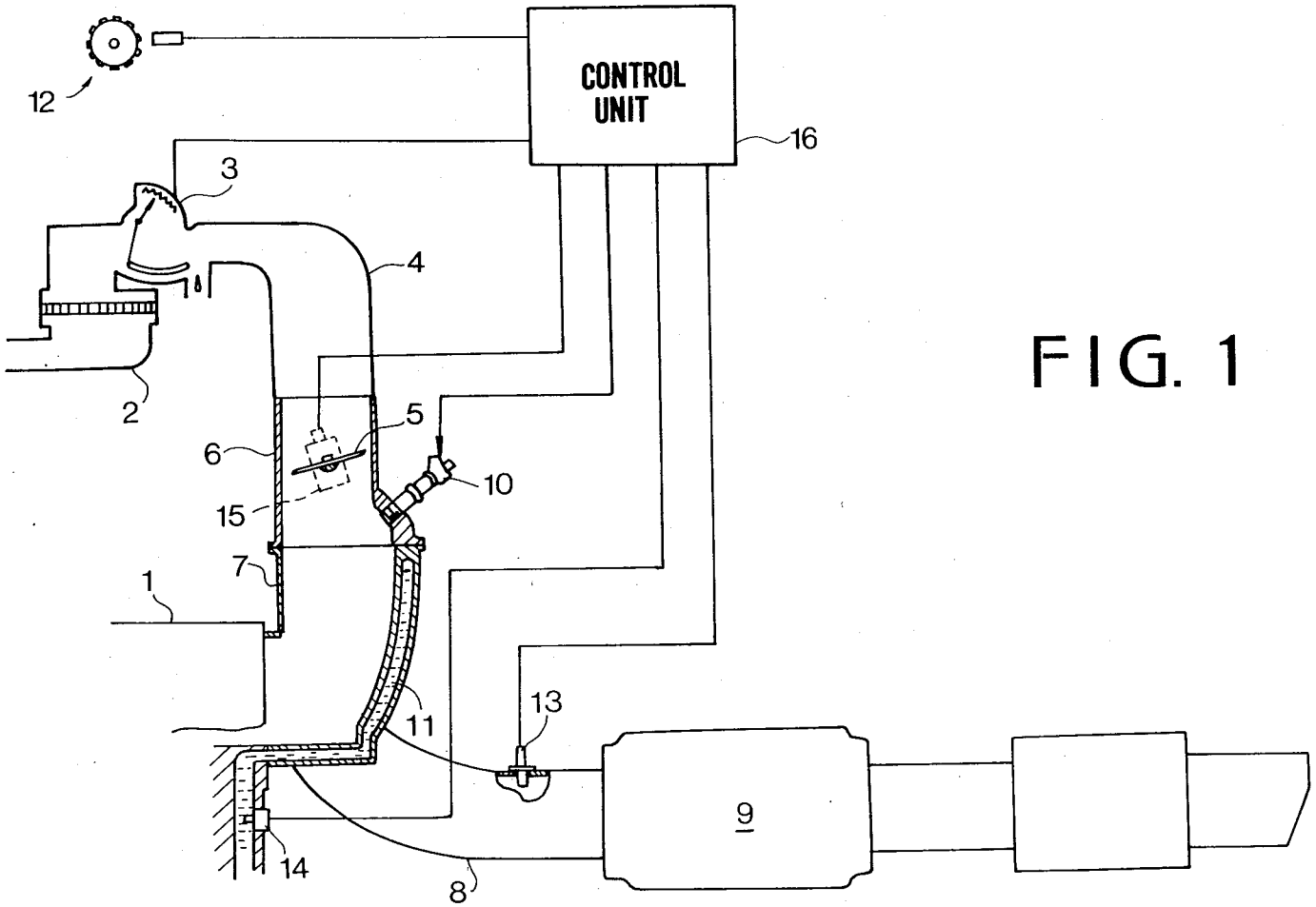
FIG. 1 is a schematic diagram showing a control system of the present invention.
Figure 2A:
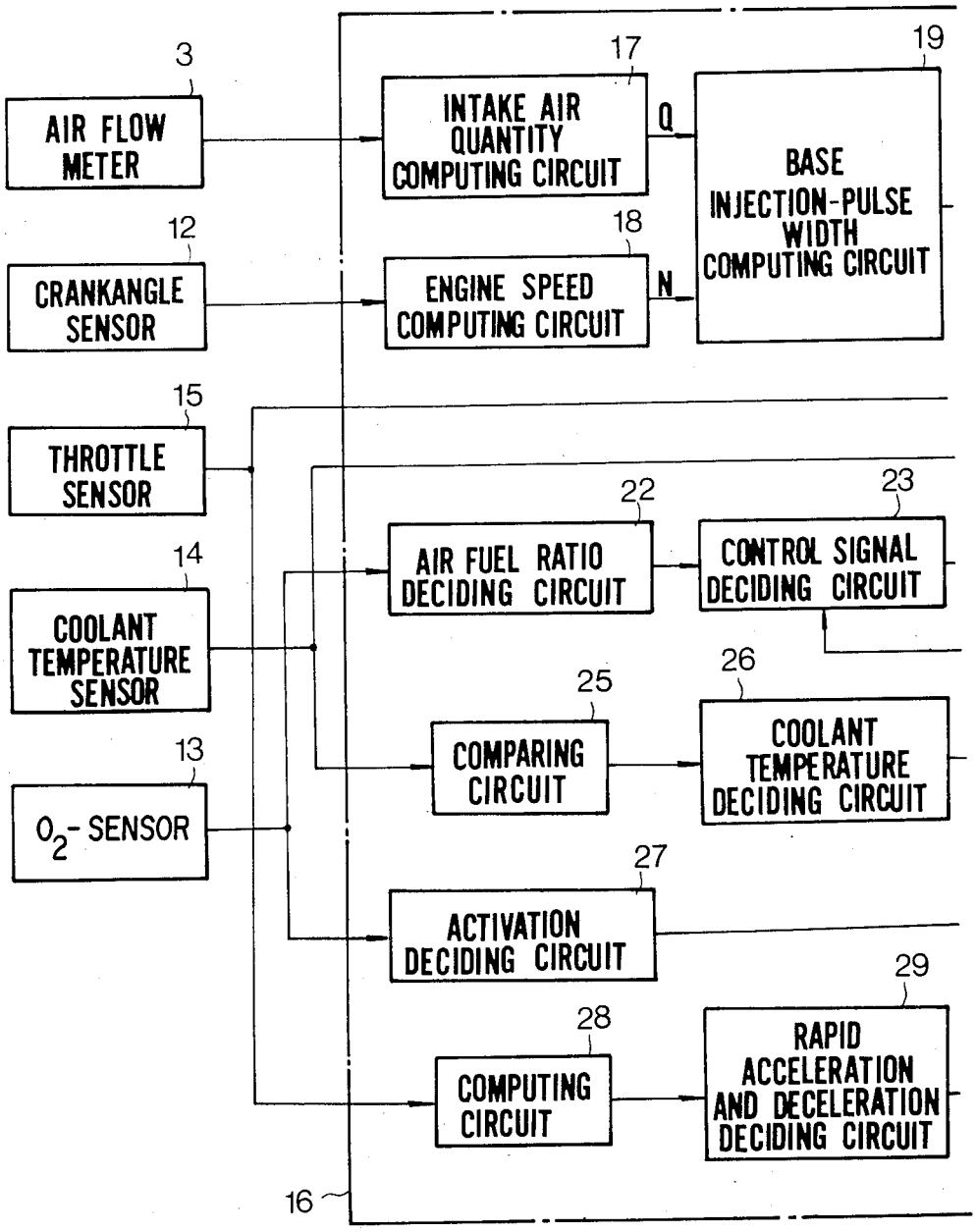
Figure 2B:
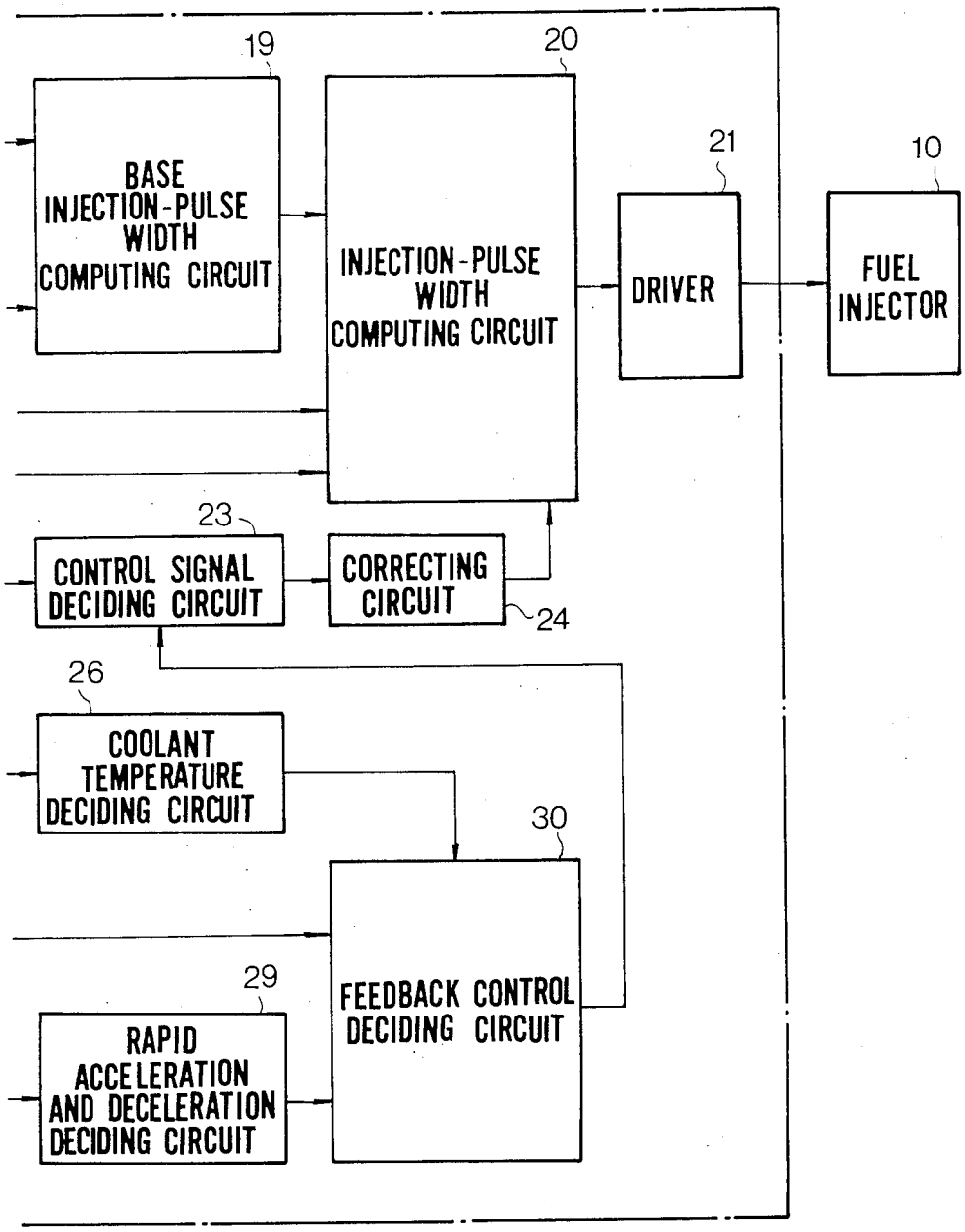
Figure 3:
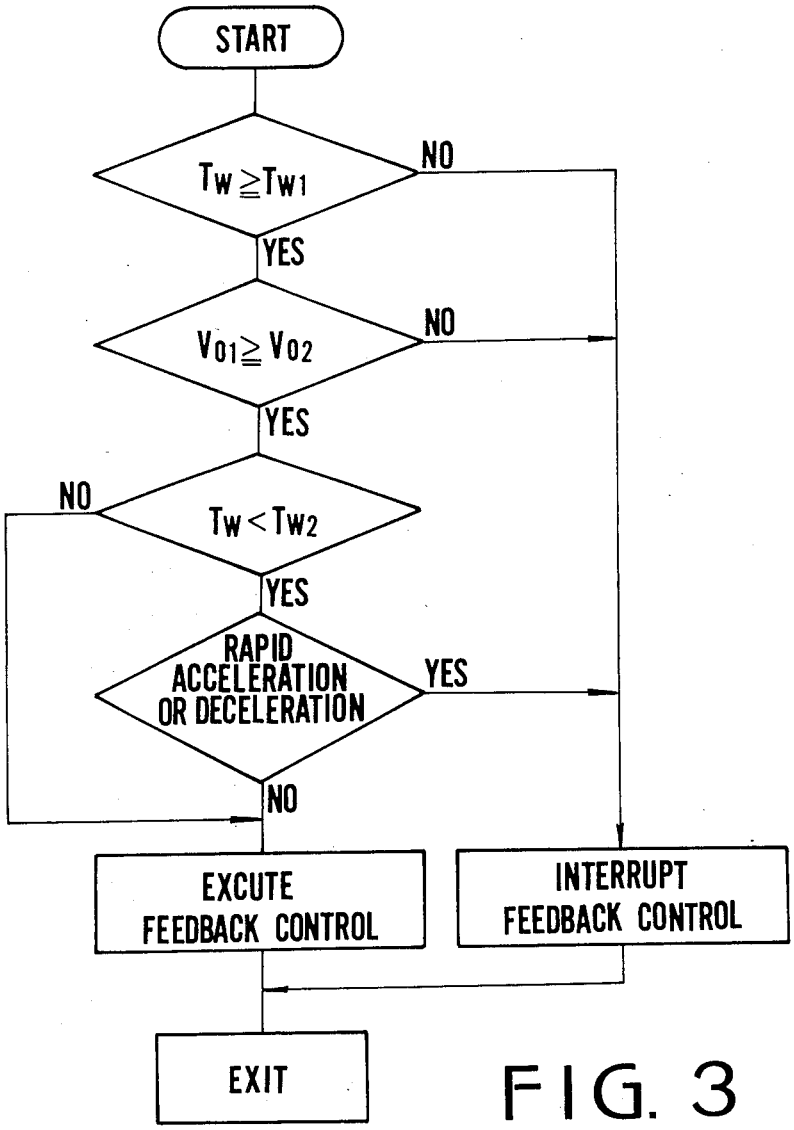
FIG. 3 is a flowchart showing the operation of the control circuit.

Referring to FIG. 1 showing schematically an air-fuel ratio control system according to the present invention, an internal combustion engine 1 mounted on a vehicle (not shown) is provided with an air flow meter 3 in an intake pipe 4 downstream of an air cleaner 2. The intake pipe 4 communicates with an intake manifold 7 through a throttle body 6 having a throttle valve 5. The intake manifold 7 communicates with cylinders of the engine, which in turn communicates with an exhaust pipe 8 having a three-way catalytic converter 9. In the throttle body 6, a single fuel-injection valve 10 is provided. On the intake manifold 7, a water jacket 11 communicating with water jackets of the engine 1 is provided to preheat the intake air.

A crankangle sensor 12 is provided for sensing engine speed (RPM), and an $O_2$-sensor 13 is provided on the exhaust pipe 8 upstream of the converter 9 to sense the concentration of oxygen in the exhaust gases. Further, a coolant temperature sensor 14 and a throttle sensor 15 for detecting the angular velocity of the throttle valve 5 are provided. Outputs of these sensors 3, 12–15 are applied to a control unit 16 to operate the fuel-injection valve 10 so as to inject the fuel in accordance with an injection signal.

Referring to FIGS. *2a, 2b* outputs of the air flow meter 3 and crankangle sensor 12 are applied to an intake air quantity computing circuit 17 and to an engine speed computing circuit 18, respectively. Intake air quantity Q and engine speed N are applied to a base injection-pulse width computing circuit 19 which produces a base injection-pulse width signal dependent on the signals Q and N. The base injection-pulse width signal is applied to an injection-pulse width computing circuit 20. The circuit 20 operates to correct the base injection-pulse width signal in accordance with signals from the coolant temperature sensor 14 and the throttle sensor 15 to produce an injection-pulse width signal dependent on cold engine operation and acceleration or deceleration of the engine. The injection-pulse width signal is fed to the fuel injector 10 through a driver 21 to inject the fuel.

The air-fuel ratio feedback control system comprises an air-fuel ratio deciding circuit 22 applied with the output of the $O_2$-sensor 13, a control signal deciding circuit 23 applied with the output of the air-fuel ratio deciding circuit 22, and a correcting circuit 24 which produces a correcting quantity signal applied to the injection-pulse width computing circuit 20.

The output signal of the coolant temperature sensor 14, representing the coolant temperature Tw, is applied to a comparing circuit 25, where the output signal is compared with a feedback control executing temperature $Tw_1$ (20°–50° C.) and with a feedback control interrupting temperature $Tw_2$ (50°–80° C.) at rapid acceleration and deceleration. The output signal of the comparing circuit 25 is applied to a coolant temperature deciding circuit 26. On the other hand, the output of the $O_2$-sensor 13 is applied to an activation deciding circuit 27 in which the output voltage $Vo_1$ of the $O_2$-sensor is compared with a reference voltage $Vo_2$ for deciding whether the $O_2$-sensor 13 is activated. The output of the throttle sensor 15 is applied to a computing circuit 28 to compute the angular velocity $\alpha$ of the throttle value. The output of the computing circuit 28 representing the angular velocity $\alpha$ is applied to a rapid acceleration and deceleration deciding circuit 29. Output signals of the circuits 26, 27 and 29 are applied to a feedback control deciding circuit 30, the output of which is applied to the control signal deciding circuit 23.

Explaining the operation of the system with reference to FIGS. *2a, 2b* and 3, the injection-pulse width computing circuit 20 computes the quantity of fuel injected to one cylinder from outputs of the air flow-meter 3, crankangle sensor 12, $O_2$-sensor 13, coolant temperature sensor 14, and throttle sensor 15. When the coolant temperature Tw is lower than the feedback control executing temperature $Tw_1$, or the output voltage $Vo_1$ of the $O_2$-sensor 13 does not reach the $O_2$-sensor activated voltage $Vo_2$, or the control temperature TW is lower than the feedback control interrupting temperature $TW_2$ when rapid acceleration or deceleration occurs, the feedback control deciding circuit 30 produces a feedback control interrupt signal which is applied to the control signal deciding circuit 23. In accordance with the interrupt signal, the circuit 23 produces a control signal for interrupting the feedback control. Accordingly, the injection-pulse width computing circuit 20 produces an output signal, so that the fuel injector 10 injects the fuel regardless of the output of the $O_2$-sensor 13.

When the coolant temperature Tw is higher than the temperature $Tw_1$, and the voltage $Vo_1$ is higher than the voltage $Vo_2$, and the coolant temperature Tw is higher than the temperature $Tw_2$ or if it is lower than the temperature $Tw_2$ when rapid acceleration or deceleration does not occur, the feedback control deciding circuit 30 produces a feedback control executing signal which is applied to the control signal deciding circuit 23. Thus, the injection-pulse width computing circuit 20 produces an output signal corrected by the output signal of the $O_2$-sensor. When the air-fuel ratio is larger than the stoichiometry (lean air-fuel mixture), the circuit 20 produces an enriching signal, and vice versa. Thus, the feedback control operation is performed, although the coolant temperature Tw is lower than the temperature $Tw_2$ when rapid acceleration or deceleration does not occur.

Under the feedback control operation at a coolant temperature lower than the feedback control interrupt temperature $Tw_2$, when the occurrence of rapid acceleration or deceleration is determined by the circuit 29, the feedback control deciding circuit 30 produces the feedback control interrupt signal. Thus, the fuel injector 10 injects the fuel in accordance with the signal.

When the coolant temperature Tw is higher than the temperature $Tw_2$, which means the completion of warming-up of the engine, the feedback control is executed. Since the fuel is sufficiently vaporized by the intake air pre-heated by the coolant in the water jacket 11, the feedback control operation can be performed without delay.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. In an air-fuel ratio control system for an internal combustion engine having an intake passage, fuel supply means for supplying fuel to cylinders of the engine through the intake passage in dependency on engine operating conditions, an exhaust passage from the engine, an $O_2$-sensor for detecting the concentration of oxygen in exhaust gases passing through the exhaust passage, an electronic feedback control circuit comprising a comparator for comparing an output signal of the $O_2$-sensor, control circuit means responsive to an output of the comparator to produce a control signal, and a driving circuit responsive to the control signal for driving the fuel supply means and for controlling air-fuel ratio in the intake passage to a value approximately equal to a stoichiometric air-fuel ratio, the improvement comprising coolant temperature sensor means for producing a temperature signal dependent on temperature of coolant of the engine, first detecting means for detecting rapid acceleration and deceleration respectively of the engine for producing an engine operation signal, comparing means for comparing the temperature signal with a lower temperature and a higher temperature, respectively, for producing a first signal when the coolant temperature is lower than the lower temperature and for producing a second signal when the coolant temperature is lower than said higher temperature, first means responsive to said first signal of said comparing means for producing a feedback control interrupting signal for rendering said electronic feedback control circuit inoperative, and said first means responsive simultaneously to the second signal and to the engine operation signal for producing said feedback control interrupting signal for rendering said electronic feedback control circuit inoperative.

2. The system as set forth in claim 1, wherein said first detecting means is for producing another engine operation signal when rapid acceleration and deceleration of the engine are not detected, and said first means is responsive to said second signal and simultaneously to said another engine operation signal for enabling said electronic feedback control circuit to operate.

3. The system as set forth in claim 1, wherein said comparing means is for comparing the temperature signal with said higher temperature for producing a third signal when the coolant temperature is higher than said higher temperature, said first means responsive to said third signal for enabling said electronic feedback control circuit to operate.

4. The system as set forth in claim 3, wherein said first detecting means is for producing another engine operation signal when rapid acceleration and deceleration of the engine are not detected, and said first means is responsive to said second signal and simultaneously to said another engine operation signal for enabling said electronic feedback control circuit to operate.

5. In an air-fuel ratio control system for an internal combustion engine having an intake passage, fuel supply means for supplying fuel to cylinders of the engine through the intake passage in dependency on engine operating conditions, an exhaust passage from the engine, an $O_2$-sensor for detecting the concentration of oxygen in exhaust gases passing through the exhaust passage, an electronic feedback control circuit comprising a comparator for comparing an output signal of the $O_2$-sensor, control circuit means responsive to an output of the comparator to produce a control signal, and a driving circuit responsive to the control signal for driving the fuel supply means and for controlling air-fuel ratio in the intake passage to a value approximately equal to a stoichiometric air-fuel ratio, the improvement comprising coolant temperature sensor means for producing a temperature signal dependent on temperature of coolant of the engine, first detecting means for detecting rapid acceleration and deceleration respectively of the engine for producing an engine operation signal, comparing means for comparing the temperature signal with a temperature range between a lower temperature and a higher temperature, for producing a first signal when the coolant temperature is lower than the lower temperature and for producing a second signal when the coolant temperature is in said temperature range, first means responsive to said first signal of said comparing means for producing a feedback control interrupting signal for rendering said electronic feedback control circuit inoperative, and said first means responsive to the second signal and to the engine operation signal for producing said feedback control interrupting signal for rendering said electronic feedback control circuit inoperative.

6. The air-fuel ratio control system according to claim 5 wherein the first detecting means is a throttle sensor for detecting the angular velocity of a throttle valve of the engine.

7. The air-fuel ratio control system according to claim 5, wherein said first means is arranged to apply the feedback control interrupting signa to the control circuit means in the feedback control circuit.

8. The air-fuel ratio control system according to claim 5 further comprising second detecting means for detecting the activation of the $O_2$-sensor and for producing a third signal which is a condition for executing the feedback control operation.

9. The air-fuel ratio control system according to claim 8 wherein the second detecting means comprises a deciding circuit for comparing the output voltage of the $O_2$-sensor with a reference voltage which is an $O_2$-sensor activated voltage.

* * * * *